US008104232B2

(12) United States Patent
Cooper

(10) Patent No.: US 8,104,232 B2
(45) Date of Patent: Jan. 31, 2012

(54) ROTATABLE BUILDING

(75) Inventor: James Nicholas Cooper, Huddersfield (GB)

(73) Assignee: Tervinder Singh Nazran, Birmingham (GB)

( * ) Notice: Subject to any disclaimer, the term of this patent is extended or adjusted under 35 U.S.C. 154(b) by 298 days.

(21) Appl. No.: 12/376,611

(22) PCT Filed: Aug. 8, 2007

(86) PCT No.: PCT/GB2007/003007

§ 371 (c)(1),
(2), (4) Date: Feb. 6, 2009

(87) PCT Pub. No.: WO2008/017835

PCT Pub. Date: Feb. 14, 2008

(65) Prior Publication Data

US 2010/0126080 A1 May 27, 2010

(30) Foreign Application Priority Data

Aug. 8, 2006 (GB) ..... 0615675.6

(51) Int. Cl.
*E04B 1/346* (2006.01)

(52) U.S. Cl. ..... 52/65

(58) Field of Classification Search ..... 52/64–65
See application file for complete search history.

(56) References Cited

U.S. PATENT DOCUMENTS 3,388,513 A * 6/1968 Bauer ..... 52/65
3,855,755 A 12/1974 Burdick
4,594,044 A 6/1986 Soot
4,969,300 A * 11/1990 Pope ..... 52/65
6,457,280 B1 * 10/2002 Park ..... 52/65
6,672,221 B2 * 1/2004 Hadley ..... 104/35
6,742,308 B1 * 6/2004 Johnstone et al. ..... 52/65

FOREIGN PATENT DOCUMENTS

| | | |
|---|---|---|
| CH | 566 458 | 9/1975 |
| DE | 19650278 | 6/1998 |
| DE | 10129255 | 12/2002 |
| WO | WO 02/103126 | 12/2002 |

OTHER PUBLICATIONS

International Search Report, mailed Mar. 12, 2007 in International Application No. PCT/GB2007/003007.
Search Report, mailed Jan. 15, 2007 in British Application No. GB 0615675.6.
EPC Communication mailed Nov. 17, 2010 in co-pending European Application No. 07 789 141.4-1255, 4 pages.

* cited by examiner

*Primary Examiner* — Brian Glessner
*Assistant Examiner* — Beth Stephan
(74) *Attorney, Agent, or Firm* — McKeon Meunier Carlin & Curfman LLC

(57) ABSTRACT

A rotatable building structure that comprises: a vertically extending building having one or more floors; a fixed core support for supporting the building, located substantially centrally beneath the building; a rotatable annular drive system for rotating the building, located lower than the building and with its centre substantially aligned with the vertical centerline of the building, the system having an upper surface and a planar lower surface; and a fixed outer support, located beneath the annular drive system, the support having a planar upper surface that contacts the planar lower surface of the annular drive system; wherein at least one of the lower surface of the annular drive system and the upper surface of the fixed outer support is a bearing material, permitting rotation of the annular drive system over the fixed outer support, such that the annular drive system is rotated via a planar to planar bearing system.

19 Claims, 6 Drawing Sheets

ROTATABLE BUILDING

The present invention relates to a building structure and, in particular, a rotatable building structure.

Rotating structures are known in the art, which generally relate to the rotation of a single level or enclosure, such as a rotating restaurant.

However, building structures may of course be very heavy and consequently the design of a rotating building that is capable of rotating, regardless of whether it is small and light or large and heavy, is not straightforward. The bearing requirements to move an entire building can be considerable and consideration has to be given to lateral loads applied due to the building, in particular due to wind or seismic loads, as well as the weight load of the building itself and its contents.

There is therefore a need for a rotatable building structure that is able to rotate regardless Of whether the building is light or heavy and that is able to withstand environmental and other factors, in particular wind, seismic effects and variations in temperature.

The present invention provides a rotatable building structure that comprises:

- a vertically extending building having one or more floors;
- a fixed core support for supporting the building, located substantially centrally beneath the building;
- a rotatable annular drive system for rotating the building, located lower than the building and with its centre substantially aligned with the vertical centreline of the building, the system having an upper surface and a planar lower surface;
- a fixed outer support, located beneath the annular drive system, the support having a planar upper surface that contacts the planar lower surface of the annular drive system; and
- wherein at least one of the lower surface of the annular drive system and the upper surface of the outer support comprises a bearing material, permitting rotation of the annular drive system over the fixed outer support,
- such that the annular drive system is rotated via a planar to planar bearing system.

The use of a planar to planar bearing system for rotation is particularly beneficial as it permits the drive system to successfully rotate heavy as well as light buildings, even in the presence of lateral forces on the building such as wind or seismic loads. Furthermore, such a system is tolerant in terms of manufacturing maintenance and installation tolerances.

The system of the present invention may be used for rotating any size, height and weight of building.

In particular, the system of the present invention may be used for heavy buildings, e.g. buildings having loads of up to 10000 ton mass or higher, preferably up to 25000 ton mass or higher, such as up to 50000 ton mass or higher, e.g. 65000 ton mass or higher. (1 ton=1000 kg).

In comparison, non-planar bearing systems, e.g. ball bearing or roller based bearing systems, require each curved bearing surface on each ball bearing or roller to be identical in order to ensure even load distribution. Furthermore, the tracks on which the curved surfaces lie also need to be precisely installed and/or machined. This results in a system that is expensive if it is to be reliable.

The rotatable annular drive system is suitable for rotating the building. Accordingly, when the rotatable annular drive system rotates, the building is likewise caused to rotate. This may, for example, be due to forces such as friction, or due to physical connectors being used to connect the annular drive system to the building.

In one embodiment, when the rotatable annular drive system rotates, the building is likewise caused to rotate due to the upper surface of the system being attached to the building. The attachment may be due to the use of physical connectors for attaching a building to a foundation component. Alternatively, friction may be used to create a degree of attachment between the upper surface of the system and the building sufficient to cause the building to rotate when the rotatable annular drive system rotates. For example, a high friction surface may be used on the upper surface of the system and/or on the lower surface of the building.

In one embodiment, the present invention provides a rotatable building structure that comprises:

- a vertically extending building having one or more floors;
- a fixed core support for supporting the building, located substantially centrally beneath the building;
- a rotatable annular drive system for rotating the building, located lower than the building and with its centre substantially aligned with the vertical centreline of the building, the system having an upper surface that is attached to the building and a planar lower surface;
- a fixed outer support, located beneath the annular drive system, the support having a planar upper surface that contacts the planar lower surface of the annular drive system; and
- wherein at least one of the lower surface of the annular drive system and the upper surface of the fixed outer support is a bearing material, permitting rotation of the annular drive system over the fixed outer support,
- such that the annular drive system is rotated via a planar to planar bearing system.

In the system of the present claimed invention, the fixed outer support may be discrete or continuous.

In one embodiment, there is a single continuous fixed outer support that extends beneath the planar lower surface of the annular drive system. This single continuous fixed outer support may be any suitable shape, for example square, circular or rectangular, provided that it is present beneath sufficient of the lower surface of the annular drive system such that the annular drive system can rotate over the fixed outer support. In one embodiment, it is present beneath substantially all or all of the lower surface of the annular drive system.

In a preferred embodiment the single continuous fixed outer support is annular. The annular shape may suitably have substantially the same internal diameter as the annular drive system. The annular shape may suitably have substantially the same external diameter as the annular drive system.

In an alternative embodiment, the fixed outer support is made up of two or more discrete units. For example, the fixed outer support may be made up of five or more discrete units, preferably ten or more discrete units, such as twenty or more discrete units, for example thirty or more discrete units, such as forty or more discrete units, e.g. forty two or more discrete units.

The use of a modular system is beneficial. The use of two or more discrete units may be advantageous in that it allows for more ready replacement of the fixed outer support in the event its upper surface becomes worn. In one embodiment, the discrete units making up the fixed outer support are adapted such that each can be jacked up. This then enables the adjacent discrete units to be pressurised, thus relieving the load on the discrete unit to be replaced.

The fixed outer support made up from two or more discrete units may be any suitable shape, for example square, circular or rectangular, provided that it is present beneath sufficient of the lower surface of the annular drive system such that the annular drive system can rotate over the fixed outer support.

In one embodiment, it is present beneath substantially all or all of the lower surface of the annular drive system.

In a preferred embodiment the fixed outer support made up from discrete units is annular. The annular shape may suitably have substantially the same internal diameter as the annular drive system. The annular shape may suitably have substantially the same external diameter as the annular drive system.

The fixed outer support and the fixed core support may, in one embodiment be integral, forming a single support unit. In an alternative embodiment, the fixed outer support and the fixed core support are separate.

The planar upper surface of the fixed outer support and the planar lower surface of the annular drive system may be the same or different materials.

Any suitable materials may be used to form the planar upper surface of the fixed outer support and the planar lower surface of the annular drive system.

However, at least one of the planar lower surface of the annular drive system and the planar upper surface of the fixed outer support comprises a bearing material, permitting rotation of the annular drive system over the fixed outer support. As the skilled man would appreciate, it is only necessary for at least one of these surfaces to be a bearing material in the region where the surfaces in use contact one another in order to permit rotation of the annular drive system over the fixed outer support via a planar to planar bearing system. However, bearing material may additionally be present in some or all of the remaining regions of these surfaces.

In one embodiment, at least one of the planar lower surface of the annular drive system and the planar upper surface of the fixed outer support is a bearing material, permitting rotation of the annular drive system over the fixed outer support.

In one embodiment both the planar lower surface of the annular drive system and the planar upper surface of the fixed outer support comprise bearing materials. Suitably, each of these surfaces is a bearing material in the region where the surfaces in use contact one another in order to permit rotation of the annular drive system over the fixed outer support via a planar to planar bearing system.

In one such embodiment both the planar lower surface of the annular drive system and the planar upper surface of the fixed outer support are bearing materials.

In an alternative embodiment, only the planar lower surface of the annular drive system comprises bearing material. Suitably, the planar lower surface of the annular drive system is a bearing material in the region where it in use contacts the planar upper surface of the fixed outer support in order to permit rotation of the annular drive system over the fixed outer support via a planar to planar bearing system.

In one such embodiment, only the planar lower surface of the annular drive system is bearing material.

In a further alternative embodiment, only the planar upper surface of the fixed outer support comprises bearing material. Suitably, the planar upper surface of the fixed outer support is a bearing material in the region where it in use contacts the planar lower surface of the annular drive system in order to permit rotation of the annular drive system over the fixed outer support via a planar to planar bearing system.

In one such embodiment, only the planar upper surface of the fixed outer support is bearing material.

The bearing material may be present due to there being a coating or layer of bearing material provided on the lower surface of the annular drive system and/or the upper surface of the fixed outer support. Alternatively, the bearing material may be present due to the lower surface of the annular drive system being made from bearing material and/or the upper surface of the fixed outer support being made from bearing material.

Examples of suitable bearing materials include: alloys, such as bronze; plastics materials, such as PTFE (e.g. Teflon®); greased metals, such as greased steel or greased stainless steel; and oil filled pads.

Preferably, the bearing materials have a static coefficient of friction of 0.3 or lower, such as 0.25 or lower; more preferably 0.2 or lower, such as 0.15 or lower; most preferably 0.1 or lower, such as 0.075 or lower, for example 0.05 or lower, such as 0.01 or lower, e.g. 0.0075 or lower.

Preferably, the bearing materials have a dynamic coefficient of friction of 0.3 or lower, such as 0.25 or lower; more preferably 0.2 or lower, such as 0.15 or lower; most preferably 0.1 or lower, such as 0.075 or lower, for example 0.05 or lower, e.g. 0.01 or lower.

Preferably, the bearing materials have a static coefficient of friction and a dynamic coefficient of friction that differ by 0.05 or less, preferably 0.01 or less, for example 0.0075 or less, more preferably 0.005 or less, most preferably 0.0025 or less, e.g. 0.001 or less.

The planar surfaces may be lubricated/greased or unlubricated/ungreased in order to achieve an appropriate coefficient of friction.

The use of bearing materials that have a small difference between the dynamic and static coefficients of friction is preferable, because a 'judder' could be created if a significant variation between the static and dynamic exists.

It is therefore preferred that lubricant/grease is present on the surfaces of the planar to planar bearing system in order to reduce the possibility of 'judder' occurring, in particular through forced lubrication of the surfaces of the planar to planar bearing system.

In those embodiments where one of the planar lower surface of the annular drive system and the planar upper surface of the fixed outer support is not a bearing material, the surface may be any other suitable material. Equally, in those embodiments where not all of the planar lower surface of the annular drive system and/or not all of the planar upper surface of the fixed outer support is not a bearing material, the remaining surface may be any other suitable material. For example, the surface may be steel or stainless steel.

The annular drive system and building may contact each other directly. In one embodiment, the annular drive system and building may contact each other and be attached to one another directly. Conventional physical connectors for attaching a building to a foundation component may suitably be used.

Alternatively, the annular drive system may cause the building to rotate when it rotates due to indirect means. In one such alternative embodiment, the annular drive system and building may be attached indirectly. For example, the lower surface of the building may be connected to the upper surface of the annular drive system via one or more other components. Conventional means for attaching a building to a foundation component may suitably be used.

The annular drive system may be any suitable size in view of the building size. Preferably, the annular drive system is sized such that it is located close to the edge of the building base, for example less than 0.5 m from the edge of the building base, such as less than 0.1 m from the edge of the building base. In on embodiment, the annular drive system has a diameter of 15 m or more, such as 20 m or more, e.g. about 20 to about 25 m.

The annular drive system suitably comprises an annular drive ring and one or more drive means for turning the drive ring.

The or each drive means may be attached to the annular drive ring. Alternatively, the or each drive means may contact and engage with the annular drive ring to turn it, e.g. by engaging with teeth on the drive ring.

The or each drive means may be any suitable means for turning the ring. For example, the drive means may be selected from: linear actuators, gears (for example gears that drive onto a gear annulus ring), and grip and push clamp systems.

When linear actuators are used, these may be mechanical or electrical and may in particular be selected from rams, Including hydraulic and pneumatic rams, and screw jacks, including ball screw jacks.

The use of linear actuators is particularly advantageous because they allow the delivery of more torque than other drive means, e.g. gearboxes, which is in particular useful when the building to be rotated is heavy.

In one embodiment, the annular drive system comprises an annular drive ring and one or more linear actuators for turning the drive ring.

Suitably, the annular drive system comprises an annular drive ring and two or more linear actuators for turning the drive ring, such as four or more linear actuators, preferably six or more linear actuators, for example ten or more linear actuators. In one embodiment the annular drive system comprises an annular drive ring and twenty or more linear actuators for turning the drive ring, such as twenty-four or more linear actuators, for example twenty-eight or more linear actuators.

Preferably, the linear actuators are equally spaced.

There may be drive means located only outside the drive ring, or there may be drive means located only inside the drive ring, or there may be drive means located both inside and outside the drive ring.

In one embodiment there are linear actuators located only inside the drive ring.

In an alternative embodiment there are linear actuators located only outside the drive ring.

In a preferred embodiment there are linear actuators located both inside and outside the drive ring. In particular, these linear actuators may be provided in pairs, with one of each pair being located outside the ring and the other being at a corresponding location inside the ring.

Preferably, the linear actuators in each pair are at an angle to each other; more preferably the linear actuators in each pair are angled such that the force they provide in the direction of turning the drive ring is additive but the force each provides in directions other than the direction of turning the drive ring is cancelled out by the other actuator in the pair.

The annular drive system may be indexed or continuous. Accordingly, the building may be rotatable in an indexed fashion, by set increments, or continuously.

In one embodiment, the annular drive system is indexed, and comprises a ratcheted annular drive ring and a set of one or more drive means for turning the drive ring by one or more ratcheted amounts in a single direction. In one embodiment, the system further comprises second set of one or more drive means, in the opposite direction to the first set of drive means, such that the building could be indexed in either direction.

The annular drive ring may be discrete or continuous.

In one embodiment, there is a single continuous annular drive ring. In an alternative embodiment, the annular drive ring is made up of two or more discrete units. For example, the annular drive ring may be made up of five or more discrete units, preferably ten or more discrete units, such as twenty or more discrete units, for example thirty or more discrete units, such as forty or more discrete units, e.g. forty two or more discrete units.

When the annular drive ring is made up of discrete units, these may or may not contact each other, provided that the annular drive ring units are able to move over the fixed outer support such that the annular drive system is rotated via a planar to planar bearing system.

The use of a modular system is beneficial. The use of two or more discrete units may be advantageous in that it allows for more ready replacement of the annular drive ring in the event its lower surface becomes worn. In one embodiment, the discrete units making up the annular drive ring are adapted such that each can be jacked up. This then enables the adjacent discrete units to be pressurised, thus relieving the load on the discrete unit to be replaced.

The annular drive ring and fixed outer support may both be made up of two or more discrete units. In this case, the annular drive ring and fixed outer support therebelow, with the annular ring being rotatable over the fixed outer support, may be provided by the use of pot bearings arranged into a ring shape. For example twenty or more pot bearings may be arranged into a ring shape, preferably thirty or more pot bearings, such as forty or more pot bearings, e.g. forty two or more pot bearings. The pot bearings may have any suitable combination of sliding/bearing surfaces, in accordance with the above discussion of the suitable materials for the planar surfaces; for example dimpled PTFE surface with a stainless steel surface.

The units for the annular drive ring and/or the units for the fixed outer support may be any suitable shape and size. They may, for example, each be independently be selected from rectangular, square and circular shapes.

The number of units for the annular drive ring and/or units for the fixed outer support may be selected appropriately in view of the weight and height of the building. Equally, the shape and size of these units may be selected bearing in mind the weight and height of the building.

The building structure may comprise one or more portions that are stationery and that bear the majority of the building weight (load) when the building is to be stationery, whilst the annular drive system may comprise one or more portions that move and that that bear at least a portion of the building weight when the building is to be rotated, the building structure further comprising means for transferring load from the stationery portions to the moveable portions.

Sufficient load should be transferred to the moveable portions such that when the moveable portions are moved, this causes rotation of the building.

The stationery portions may, for example, bear 80% or more, such as 90% or more, e.g. 95% or more of the building weight when the building is to be stationery. Accordingly, when the building is to be stationery the moveable portions may, for example, bear 20% or less of the building weight, e.g. about 5 to 20%.

When load has been transferred, when the building is to be rotated, the moveable portions may, for example, bear at least 50% or more of the building weight when the building is to be rotated, such as 60% or more; preferably the moveable portions bear 70% or more of the building weight when the building is to be rotated, for example 80% or more, e.g. 90% or more, such as 95% or more.

In this embodiment, in order to permit rotation of the annular drive system over the fixed outer support via a planar to planar bearing system, it is only necessary for at least one of the planar lower surface of the moveable portions of the annular drive system and the planar upper surface of the fixed outer support to be a bearing material in the region where the planar lower surface of the moveable portions of the annular drive system and the planar upper surface of the fixed outer support in use contact one another.

The means for transferring load from the stationery portions to the moveable portions may, for example, be pressurisers that are used to apply pressure under the moveable portions to transfer load from the stationery portions to the moveable portions; for example inflation with a gas, such as air, or with a liquid, such as oil or water, or with wedges could be used to apply pressure under the moveable portions to transfer load from the stationery portions to the moveable portions. In one embodiment, a hydraulic fluid is used to apply pressure under the moveable portions to transfer load from the stationery portions to the moveable portions.

Suitably, the load transferors are also able to transfer load back to the stationery portions from the moveable portions. For example, if pressurisers are used, the pressure under the moveable portions can be released by de-pressurising.

The moveable portions suitably have a high friction surface, so that when the load is transferred to the moveable portions there is a degree of attachment, directly or indirectly, to the building by friction.

In one embodiment, the annular drive system includes an annular drive ring that is moveable and that bears at least a portion of the building weight when the building is to be rotated and the building system includes a stationery ring that bears the majority of the building weight (load) when the building is to be stationery, the building structure further comprising means for transferring load from the stationery portions to the moveable portions.

The stationery ring may be located inside or outside the annular ring.

In one embodiment, the annular drive system includes an annular drive ring that comprises one or more moveable pads. The annular drive ring may comprise any suitable number of pads but may preferably comprise four or more moveable pads, e.g. eight or more, such as ten or more; preferably 12 or more, e.g. 20 or more, such as 24 or more moveable pads. The moveable pads preferably can move in a circumferential motion; most preferably they slide in a circumferential motion.

In this embodiment, the building structure also includes one or more stationery pads. The building structure may comprise any suitable number of stationery pads. Preferably it comprises four or more stationery pads, e.g. eight or more, such as ten or more; preferably 12 or more, e.g. 20 or more, such as 24 or more stationery pads. In one embodiment, there are at least the same number of as stationery pads as moveable pads. Preferably, there are twice as many stationery pads as moveable pads.

In one embodiment, the moveable pads are interspaced between the stationery pads. In particular, the movable pads and the stationery pads may together form a ring that comprises alternating moveable pads and stationery pads.

When the building is stationery, the majority of the building weight (load) is on the stationery portions. However, when the building is to be rotated, at least a portion of this load is transferred onto the moveable portions and the drive means, e.g. linear actuators, move the moveable portions to in turn cause rotation of the building. Sufficient load should therefore be transferred to the moveable portions such that when the moveable portions are moved, this causes rotation of the building. After movement of the moveable portions, the load is transferred back onto the stationery portions. The moveable portions may then be returned to their original position.

The use of such a system avoids the need for a ratchet system. Additionally, bearing material need only be present at the area of contact, during movement, between the moveable portions of the annular drive ring and the outer support.

The rotatable building structure of the present invention may be provided with one or more seals as appropriate to protect the planar to planar bearing system from ingress of dirt or other contaminants.

The rotatable building structure may further comprise a load bearing body below the building. In particular, the load bearing body may be a sealed body of liquid, such as water. The sealed body of liquid may be pressurised as required to provide a desired level of load bearing.

The inclusion of such a load bearing body is advantageous as with high weight buildings the weight on the bearing may became too high, and therefore an additional load bearing body reduces the weight on the bearing. In particular, when the load bearing body is a sealed body of liquid, such as water, the liquid pressure removes some of the effective weight to the bearings and lowers the required rotational resistive force.

The pressure of the liquid is set low enough to still ensure stability of the building. The liquid pressure may be applied via a header tank, e.g. from the top of the building, and trimmed to achieve the desired operating pressure.

When not rotating it is preferred that the liquid pressure is maintained but is isolated to avoid excessive liquid loss in the accidental event of seal failure. During rotation the pressure will be reapplied and monitored to ensure correct residual bearing loads. The pressure may be selected to reduce frictional resistance but to maintain sufficient bearing load to prevent any lift-off during extreme wind loading. In a seismic event any lift-off of the bearings will cause seal rupture and will instantaneously restore the full building load to the bearing. As a further security feature, in the event of any abnormal conditions a fast-acting valve will release the liquid pressure and restore the full building load to the bearing.

The building may be rotatable by any suitable amount, for example one degree or more, such as 10 degrees or more, such as 30 degrees or more; preferably 45 degrees or more, for example 60 degrees or more; preferably 90 degrees or more, for example 135 degrees or more, such as 150 degrees or more; more preferably 180 degrees or more, for example 225 degrees or more; more preferably 270 degrees or more, for example 315 degrees or more; for example the building is rotatable by 360 degrees or more; most preferably continuously rotatable for one revolution or more, i.e. it is fully rotatable.

Preferably, the building is rotatable in both a clockwise and an anti-clockwise direction.

However, in one embodiment the building may be rotatable in one direction only, for example the building may be rotatable in only an anti-clockwise direction or the building may be rotatable in only a clockwise direction.

In one embodiment, the building comprises a first set of one or more linear actuators located so as to be able to push clockwise, and a second set of one or more linear actuators located in the opposite direction so as to be able to push anticlockwise, and thus the building is rotatable in both a clockwise and an anti-clockwise direction.

The building may be rotated at any suitable speed. In one embodiment, the building can be rotated at an annular speed of 1 mm/sec or more, such as 2 mm/sec or more, preferably 3 mm/sec or more, e.g. 5 mm /sec or more.

The building may be rotated at any suitable average (mean) speed. In one embodiment, the building can be rotated at an average (mean) annular speed of 2.5 mm/min or more, such as 5 mm/min or more, preferably 7.5 mm/min or more, e.g. 10 mm /min or more. In one embodiment, the building can be rotated at an average (mean) annular speed of 1 mm/sec or more, such as 2 mm/sec or more, preferably 3 mm/sec or more, e.g. 5 mm /sec or more.

The building rotation speed may be changed during rotation. In this regard, the building rotation speed may be increased and/or decreased during rotation. In one embodiment, there is one or more speed change during the rotation, e.g. two or more, such as three or more speed changes. The speed changes may be independently selected from one or more increase in speed and one or more decrease in speed.

When the rotation of the building is indexed, the building may rotate any suitable distance per index. For example, the building may rotate by 10 mm or more per index, such as 50 mm or more per index, preferably 100 mm or more per index, such as 250 mm or more per index, more preferably 500 mm or more per index, such as 750 mm or more per index, e.g. 800 mm or more per index.

In one embodiment, the building can be used as a time piece, e.g. a lunar time piece, weekly time piece or a time piece that indicates any other measurement of time.

The building may be any type of commercial or non-commercial building. Preferably, the building is a commercial building. For example, the building may be a hotel, restaurant, conference centre, multi-storey car park, office block, pub or club. In one embodiment, the building is a tower.

The building may have any suitable number of floors; for example it may have two or more floors, such as five or more floors; preferably ten or more floors, such as twenty or more floors, for example thirty or more floors.

The present invention will now be further described, by means of example only, with reference to the accompanying drawings in which.

Figure 1:
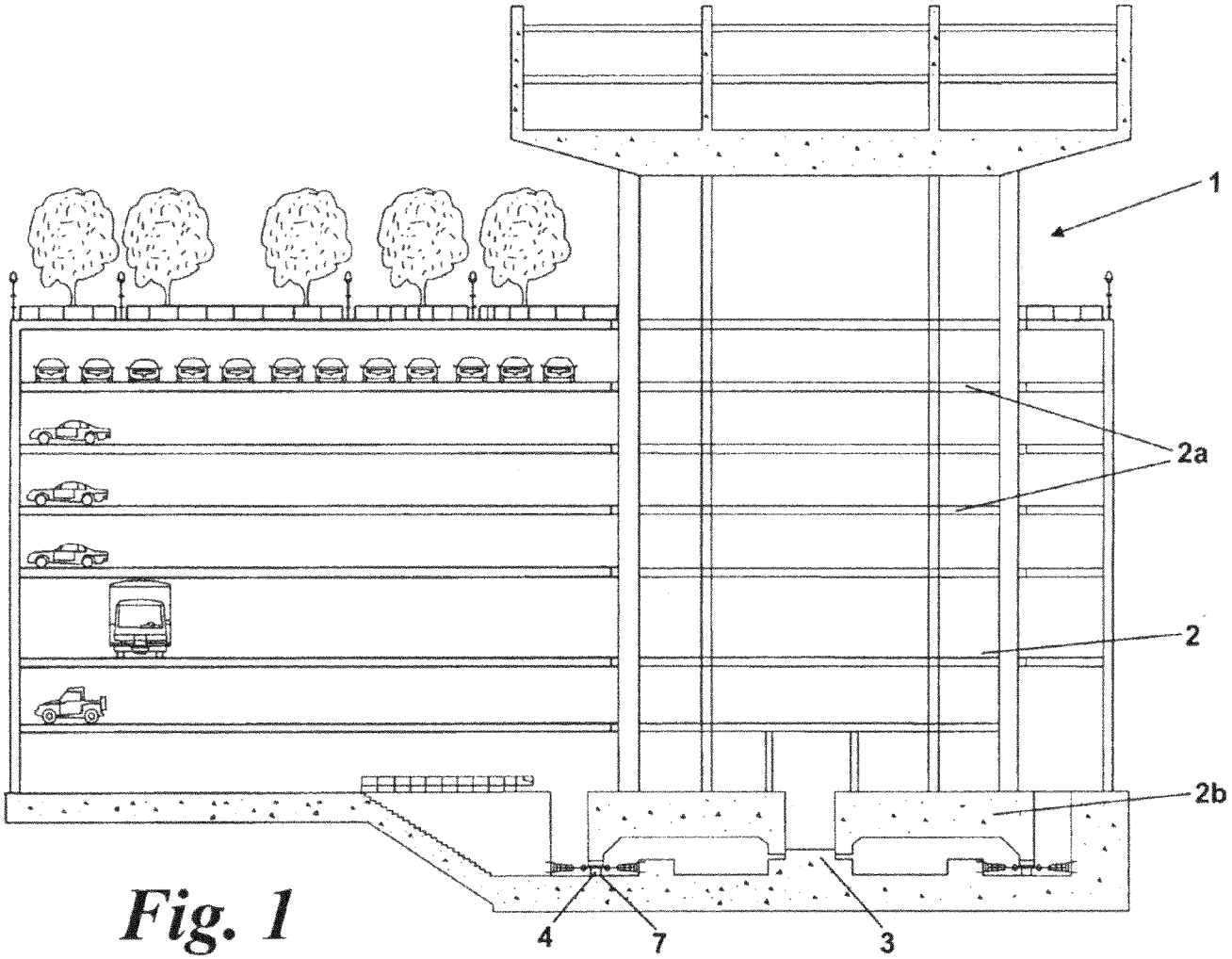
FIG. 1 is a cross sectional diagram of the lower part of a rotatable building structure in accordance with the invention.
Figure 2:
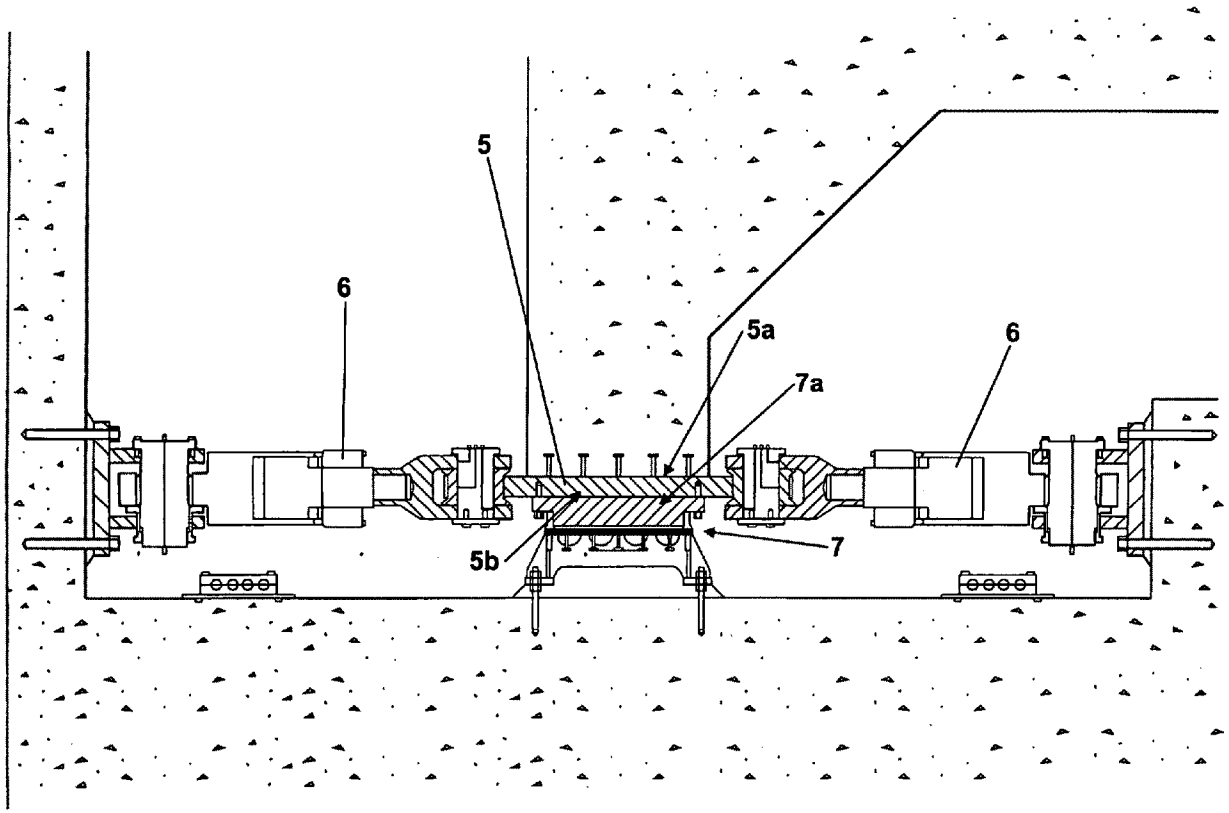
FIG. 2 is a cross sectional diagram showing in detail the annular drive system of the building structure of FIG. 1.
Figure 3:
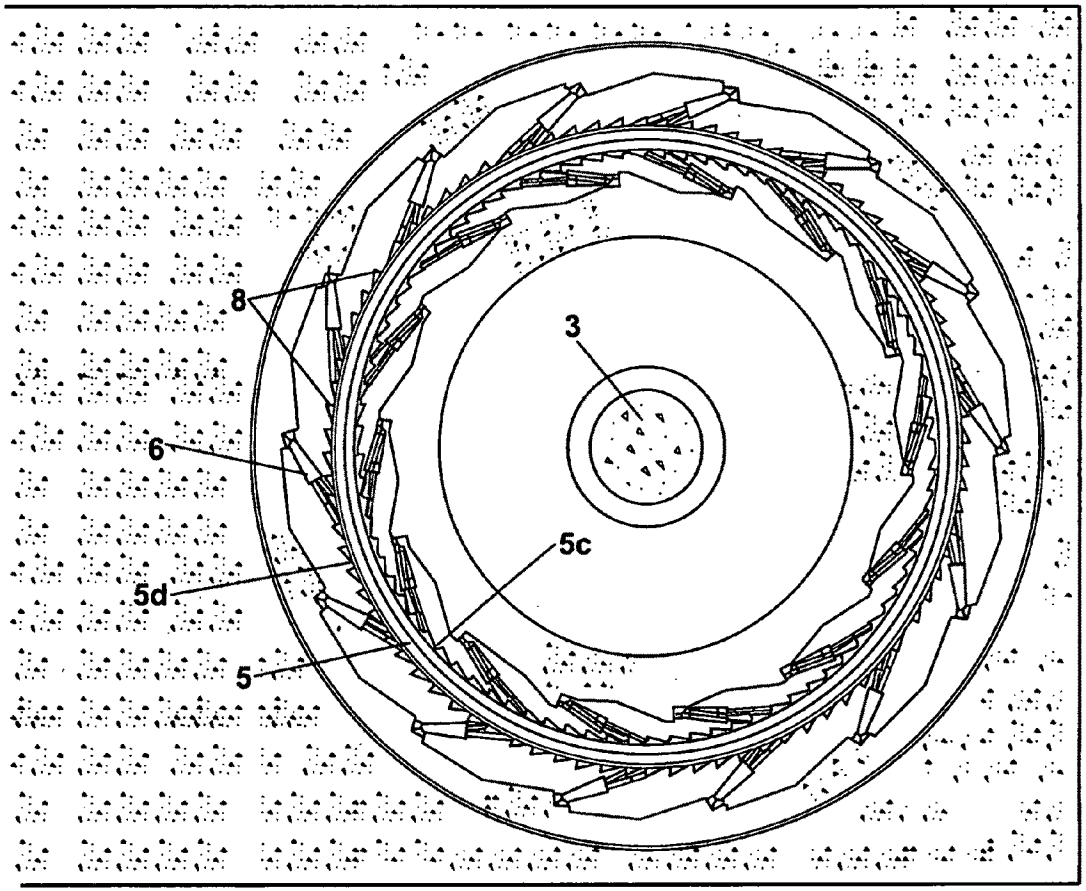
FIG. 3 is a plan diagram from above showing in detail the annular drive system of the building structure of FIG. 1.

FIGS. 1-3 show a rotatable building structure 1 that comprises a vertically extending building 2 having a number of floors 2*a*. The building is provided with a base slab 2*b* at its base.

The structure 1 also comprises a fixed central foundation support 3 for supporting the building 2. This support 3 is located centrally beneath the building 2, where it contacts the building and takes load therefrom.

The structure 1 further comprises an outer support 7, which is annular and located lower than the building 2. The annular outer support 7 is located such that the fixed central foundation support 3 is at its centre. The outer support 7 has a planar upper surface 7*a*.

The upper surface 7*a* of the outer support 7 is stainless steel.

The structure 1 further comprises a rotatable annular drive system 4. This system is located lower than the building 2, but above the outer support 7. The annular drive system 4 acts to rotate the building 2.

The annular drive system 4 comprises an annular drive ring 5 and linear actuators 6 for turning the drive ring.

The annular drive ring 5 has an upper surface 5*a* that is attached to the building 2 and a lower surface 5*b* that is planar and contacts the planar upper surface 7*a* of the outer support 7.

The annular drive ring 5 is ratcheted, being provided with a number of engaging teeth 8 around its outer curved surface 5*d* and its inner curved surface 5*c*.

In the embodiment pictured, there are a total of 84 engaging teeth around its outer curved surface 5*d* and a total of 84 engaging teeth around its inner curved surface 5*c*, but the skilled man will appreciate that any suitable number of teeth may be used depending upon the desired number of degrees to be turned per index.

In the embodiment pictured, there are twenty-eight linear actuators 6, with fourteen spaced equally around the outer curved surface 5*d* of the annular drive ring 5 and fourteen spaced equally around the inner curved surface 5*c* of the annular drive ring 5. Again, the skilled man will appreciate that any suitable number of actuators may be used depending upon the desired amount of torque.

As illustrated in FIG. 3, in this embodiment the linear actuators 6 are provided in pairs, with one of each pair being located outside the ring 5 and the other being at a corresponding location inside the ring 5.

Figure 4:
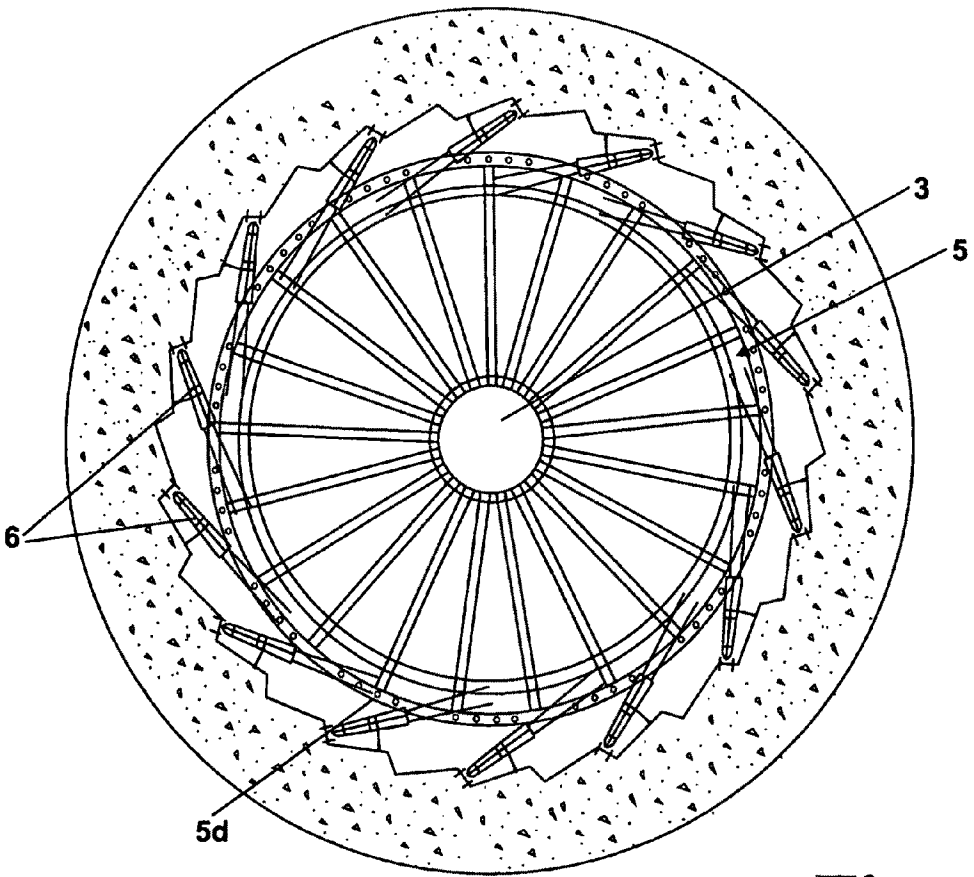
FIG. 4 is a plan diagram from above showing in detail a first alternative annular drive system that could be used in the building structure of FIG. 1.

However, in alternative embodiments the linear actuators 6 may be provided only on the inside 5*c* of the ring 5, or only on the outside 5*d* of the ring 5. FIG. 4 illustrates such an alternative annular drive system, where there are only linear actuators 6 on the outside 5*d* of the ring 5. In the embodiment of FIG. 4 the annular drive ring 5 is also not ratcheted.

In the embodiment of FIG. 3, the linear actuators 6 in each pair are tangentially angled such that the force they provide in the direction of turning the drive ring 5 is additive but the force each provides in directions other than the direction of turning the drive ring 5 is cancelled out by the other actuator in the pair. The linear actuators 6 may in particular be hydraulic rams or screw jacks.

The planar lower surface 5*b* of the annular drive system is provided with a layer of bearing material having a coefficient of friction of 0.3 or lower. In one embodiment this material is PTFE or bronze.

Accordingly, the annular drive system 4 rotates via a planar to planar bearing system, with the planar lower surface of the annular drive ring 5 being able to rotate over the upper surface 7*a* of the outer support 7.

Optionally, the surfaces of this planar to planar bearing system may be lubricated.

In use, the linear actuators 6 are used to drive the annular drive ring 5, with each linear actuator 6 engaging with an engaging tooth 8 on the annular drive ring 5. The annular drive ring therefore rotates over the upper surface 7*a* by a set ratcheted amount.

The rotation of the annular drive ring 5 lead to a corresponding rotation of the building 2 that is attached to the drive ring 5.

The building 2 is rotatable in discrete indexed rotation through as many degrees as required, i.e. it is fully rotatable.

In this example the building is only rotated in the clockwise direction as all the linear actuators are positioned so as the push in a clockwise direction.

Figure 5:
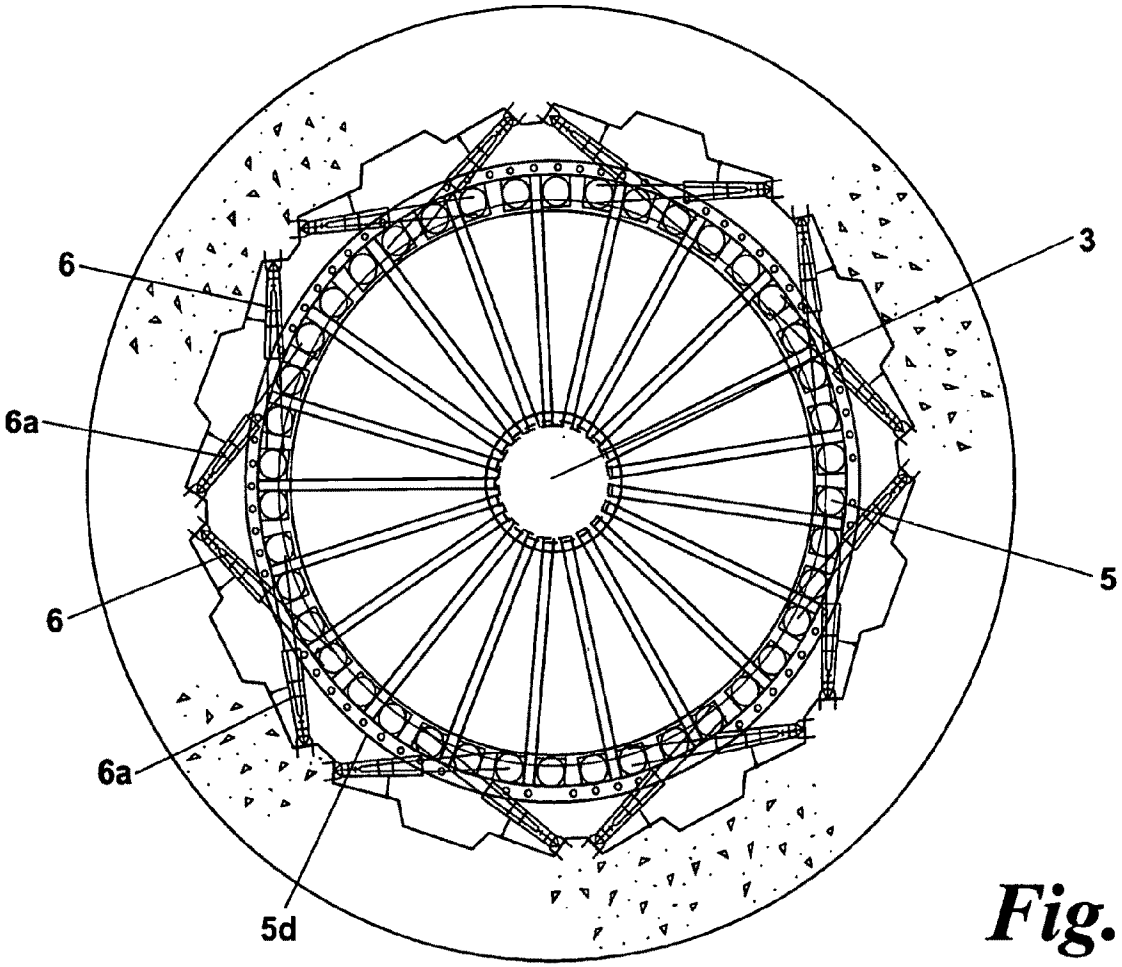
FIG. 5 is a plan diagram from above showing in detail a second alternative annular drive system that could be used in the building structure of FIG. 1.

However, as illustrated in FIG. 5, by including a second set of linear actuators 6*a* pointing in the opposite direction the building can be rotated in both a clockwise and an anti-clockwise direction. In the embodiment of FIG. 5, as in FIG.

4, there are only linear actuators 6 on the outside 5*d* of the ring 5 and the ring is not ratcheted.

Figure 6:
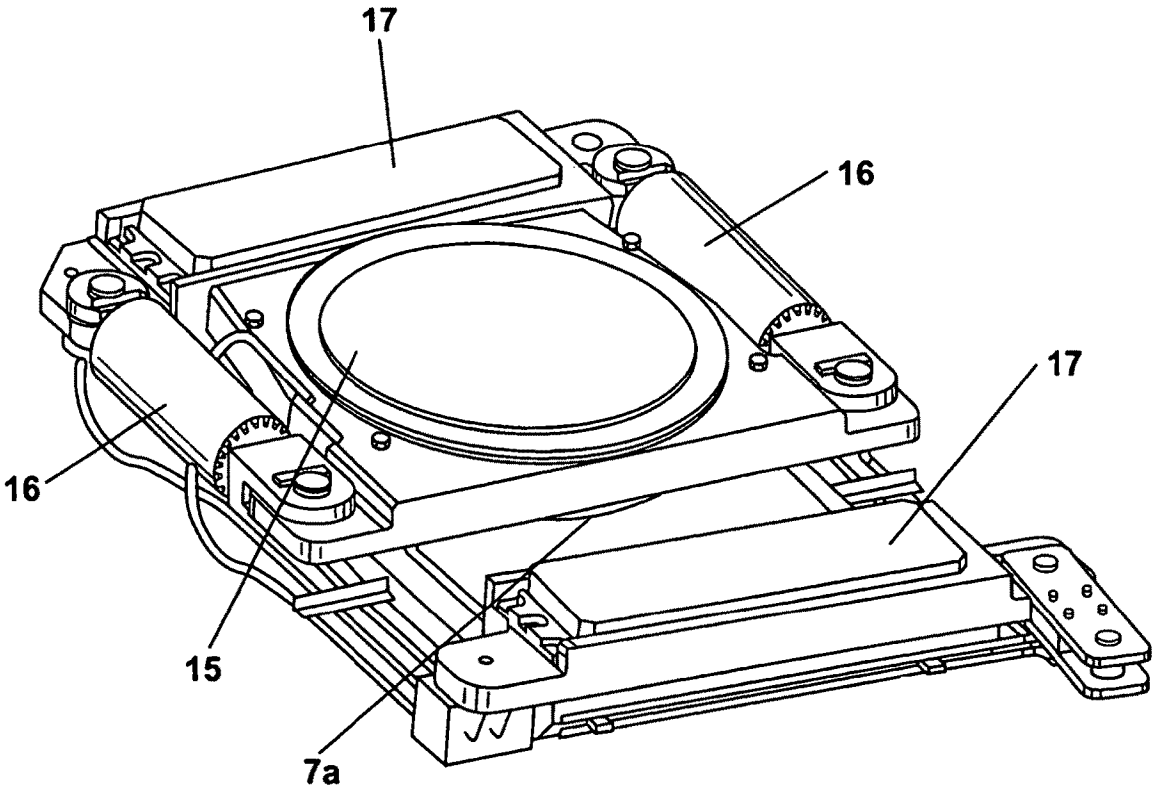
FIG. 6 is a perspective view showing in detail part of an alternative annular drive system that could be used in the building structure of FIG. 1.

In FIG. 6 part of an alternative annular drive system is shown, which could be used in the system of FIG. 1. The alternative annular drive system comprises an annular drive ring made up of a number of the moveable pads 15 shown in FIG. 6. The skilled man will appreciate that any suitable number of the moveable pads 15 could be used to make up the annular drive ring. The total number of pads to be used may in particular be selected in view of the height and weight if the building; however, there may, for example, be 24.

The moveable pads 15 are interspaced between stationery pads 17. Linear actuators 16 for moving the moveable pads are also provided.

The annular drive ring has an upper surface that contacts the building and a lower surface that is planar and contacts the planar upper surface of the outer support.

Each moveable pad 15 is shown to be attached to a pair of linear actuators 16 for moving the pad. However, the skilled man would understand that any suitable number of linear actuators could be used for moving each pad. The linear actuators 16 may in particular be hydraulic rams or screw jacks.

Each moveable pad 15 is also provided with a pressuring system (not shown), such as an oil based inflation system, for transferring at least a portion of the weight of the building (load) to the moveable pads 15 from the stationery pads 17. When the inflation system is pressurised, load is transferred to the moveable pads 15; when it is depressurised the load is transferred back to the stationery pads 17.

Sufficient load must be transferred to the moveable pads 15 such that when the moveable pads 15 are moved, the building is rotated.

The upper surface 7*a* of the outer support is provided with a layer of bearing material having a coefficient of friction of 0.3 or lower in the region where it contacts the lower surface of the moveable pads 15.

Accordingly, the annular drive system rotates via a planar to planar bearing system, with the planar lower surface of the moveable pads 15 being able to rotate over the upper surface 7*a* of the outer support.

The surfaces of this planar to planar bearing system may be lubricated.

When the building is stationery, the majority of the load is on the stationery pads 17. However, when the building is to be rotated, load is transferred onto the moveable pads 15 and the linear actuators 16 move the moveable pads 15 to cause rotation of the building. After movement of the moveable pads, the load is transferred back onto the stationery pads 17. The moveable pads 15 may then be returned to their original position.

The invention claimed is:

1. A rotatable building structure that comprises:

a vertically extending building having one or more floors;

a fixed core support for supporting the building, located substantially centrally beneath the building;

a rotatable annular drive system for rotating the building, located lower than the building and with its centre substantially aligned with the vertical centreline of the building, the system having an upper surface and a planar lower surface; and a fixed outer support, located beneath the annular drive system, the support having a planar upper surface that contacts the planar lower surface of the annular drive system;

wherein at least one of the lower surface of the annular drive system and the upper surface of the fixed outer support comprises a bearing material, permitting rotation of the annular drive system over the fixed outer support, such that the annular drive system is rotated via a planar to planar bearing system, wherein the annular drive system comprises an annular drive ring and two or more drive means for turning the drive ring, wherein there are drive means located both inside and outside the drive ring.

2. The rotatable building structure of claim 1 wherein the annular drive ring comprises one or more moveable pads that are positioned to be able to move over the planar upper surface of the fixed outer support and wherein the building structure also includes one or more stationery pads that are positioned to receive the majority of the load from the building when the building is stationery.

3. The rotatable building structure of claim 2 wherein the annular drive ring comprises four or more moveable pads.

4. The rotatable building structure of claim 2 wherein the moveable pads can slide in a circumferential motion over the planar upper surface of the fixed outer support.

5. The rotatable building structure of claim 2 wherein the building structure comprises four or more stationery pads.

6. The rotatable building structure of claim 2 wherein there are at least the same number of stationery pads as moveable pads.

7. The rotatable building structure of claim 2 wherein the moveable pads are interspaced between the stationery pads.

8. The rotatable building structure of claim 1 wherein both the planar lower surface of the annular drive system and the planar upper surface of the fixed outer support are bearing materials.

9. The rotatable building structure of claim 1 wherein the bearing material is selected from bronze and PTFE.

10. The rotatable building structure of claim 1 wherein each drive means is selected from: linear actuators, gears, and grip and push clamp systems.

11. The rotatable building structure of claim 10 wherein each drive means is a linear actuator selected from rams and screw jacks.

12. The rotatable building structure of claim 1 wherein the annular drive system comprises the annular drive ring and ten or more linear actuators for turning the drive ring.

13. The rotatable building structure of claim 1 wherein there are linear actuators located both inside and outside the drive ring.

14. The rotatable building structure of claim 13 wherein the linear actuators are provided in pairs, with one of each pair being located outside the ring and the other being at a corresponding location inside the ring.

15. The rotatable building structure of any one of claim 1 wherein the annular drive ring is made up of two or more discrete units.

16. The rotatable building structure of claim 1 wherein the building is continuously rotatable for one revolution or more.

17. The rotatable building structure of claim 1 wherein the building is rotatable in both a clockwise and an anticlockwise direction.

18. The rotatable building structure of claim 2 wherein when the building is stationery, the majority of the building load is on the stationery pads and when the building is to be rotated at least a portion of this load is transferred onto the moveable pads and the drive means can move the moveable pads to, in turn, cause rotation of the building.

19. The rotatable building structure of claim 14 wherein the linear actuators in each pair are angled such that the force they provide in the direction of turning the drive ring is additive but the force each provides in directions other than the direction of turning the drive ring is cancelled out by the other actuator in the pair.

* * * * *